US009616657B2

(12) United States Patent
Rancourt et al.

(10) Patent No.: US 9,616,657 B2
(45) Date of Patent: Apr. 11, 2017

(54) CLOSED LOOP INK THICKNESS CONTROL SYSTEM WITH REDUCED SUBSTRATE WASTE IN A PRINTING PRESS

(71) Applicant: Goss International Americas Inc., Durham, NH (US)

(72) Inventors: Michael Raymond Rancourt, Merrimack, NH (US); Brian Robert Elkinson, Barrington, NH (US); Howard W. Hoff, Lee, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 14/042,922

(22) Filed: Oct. 1, 2013

(65) Prior Publication Data

US 2015/0090136 A1 Apr. 2, 2015

(51) Int. Cl.

| | |
|---|---|
| ***B41F 7/04*** | (2006.01) |
| ***B41F 31/20*** | (2006.01) |
| ***B41F 33/00*** | (2006.01) |
| ***B41F 31/02*** | (2006.01) |
| ***B41F 7/00*** | (2006.01) |

(Continued)

(52) U.S. Cl.

CPC ..... *B41F 33/0063* (2013.01); *B41F 7/00* (2013.01); *B41F 7/04* (2013.01); *B41F 31/004* (2013.01); *B41F 31/02* (2013.01); *B41F 31/20* (2013.01); *B41F 33/10* (2013.01)

(58) Field of Classification Search

CPC ..... B41M 1/06; B41F 7/00; B41F 7/04; B41F 7/10; B41F 7/12; B41F 23/08; B41F 31/004; B41F 31/02; B41F 31/10; B41F 31/20; B41F 33/0045; B41F 33/0063

USPC ..... 101/142–145, 218, 219, 220, 247, 182, 101/184, 185, 365

See application file for complete search history.

(56) References Cited

U.S. PATENT DOCUMENTS

| | | | |
|---|---|---|---|
| 2,832,289 | A | 4/1958 | Mitchel et al. |
| 5,046,416 | A | 9/1991 | Freyer et al. |
| 5,069,124 | A | 12/1991 | Schneider |

(Continued)

FOREIGN PATENT DOCUMENTS

| | | |
|---|---|---|
| CA | 2135722 A1 | 5/1995 |

*Primary Examiner* — Leslie J Evanisko

(74) *Attorney, Agent, or Firm* — Davidson, Davidson & Kappel, LLC

(57) ABSTRACT

A method is provided of charging an inker in a lithographic printing press. The method comprises placing all of the printing units of the printing press in an off impression position, with a continuous substrate passing through the printing units, each printing unit including a blanket cylinder; and in one or more printing units of the plurality of printing units, moving the takeaway roller into contact with the blanket cylinder of the printing unit. Thereafter, the method includes driving the ink train, plate cylinder, blanket cylinder and the take away roller at a first surface speed, whereby the ink from the ink train transmitted to the plate cylinder from the ink train, from the plate cylinder to the blanket cylinder, and from the blanket cylinder to the take away roller; and during said driving step, keeping the continuous substrate stationary or moving the continuous substrate at a second surface speed less than 50% of the first surface speed. Also provided is a closed loop control system for controlling the ink film thickness applied to a printed substrate in a lithographic printing press.

16 Claims, 3 Drawing Sheets

(51) Int. Cl.
*B41F 31/00* (2006.01)
*B41F 33/10* (2006.01)

(56) References Cited

U.S. PATENT DOCUMENTS

| | | | | |
|---|---|---|---|---|
| 5,138,944 | A * | 8/1992 | Rancourt et al. | 101/365 |
| 5,235,913 | A | 8/1993 | Richardson et al. | |
| 5,372,067 | A | 12/1994 | Doyle | |
| 5,447,102 | A | 9/1995 | Pfeiffer et al. | |
| 5,884,562 | A | 3/1999 | Sugiyama et al. | |
| 5,992,318 | A * | 11/1999 | DiBello et al. | 101/181 |
| 6,367,385 | B2 | 4/2002 | Komori | |
| 6,543,354 | B1 * | 4/2003 | Straube et al. | 101/247 |
| 6,915,742 | B2 | 7/2005 | Senoo et al. | |
| 2003/0084800 | A1 | 5/2003 | Anweiler et al. | |
| 2011/0011292 | A1 * | 1/2011 | Rousseau et al. | 101/485 |
| 2012/0145018 | A1 * | 6/2012 | Elkinson et al. | 101/135 |
| 2014/0182470 | A1 * | 7/2014 | Clarke | B41F 22/00 101/416.1 |

* cited by examiner

CLOSED LOOP INK THICKNESS CONTROL SYSTEM WITH REDUCED SUBSTRATE WASTE IN A PRINTING PRESS

This application relates to the field of printing and in particular to the field of inkers for printing presses.

BACKGROUND INFORMATION

In the field of lithographic printing, ink is continuously conveyed from an ink source through a series of rollers to a printing plate on a plate cylinder in a printing press. Image portions of the printing plate accept ink from one or more of the last of a series of inking rollers and transfer a portion of that ink to a blanket cylinder as a reverse image from which a portion of the ink is transferred to form a correct-reading image on paper or other materials. It is also important in conventional lithographic printing processes that a dampening solution containing water and proprietary additives be conveyed continuously to the printing plate whereby transferring in part to the non-image areas of the printing plate the water functions to keep those non-image areas free of ink. Finally, in conventional printing press systems, the ink is continuously made available in varying amounts determined by cross-press column input control adjustments to a plurality of ink metering devices, such as ink injectors. Open fountain inker systems, and other systems, may also be used as ink metering devices.

Lithographic printing plate surfaces in the absence of imaging materials have minute interstices and a hydrophilic or water-loving property to enhance retention of water, that is the dampening solution, rather than ink on the surface of the plate. Imaging the plate fills these interstices and creates oleophilic or ink-loving areas according to the image that is to be printed. Consequently, when both ink and dampening solution are presented to an imaged plate in appropriate amounts, only the ink tending to reside in non-image areas becomes disbonded from the plate. In general, this action accounts for the continuous ink and dampening solution differentiation on the printing plate surface, which is integral to the lithographic printing process.

During a make-ready or set up process, a printing press is prepared for a new print job. In this regard, a new print job refers to printing different images on the web as compared to an existing print job. This can be accomplished, for example, by changing the printing plate(s) on a printing unit, or by bringing a different set of printing units into contact with the web. Both require make-ready, although in the latter case, sometimes referred to as auto-transfer, the make-ready for the new print job could be performed at any time prior to the job change. In any event, during this make-ready (or set up) process, the press is adjusted and stabilized before it is ready to produce an accurate and acceptable image on the printed material. For example, adjustments are made to the press color and/or registration during start up. Thereafter, the press is run for a period of time needed for the effect of the adjustments to propagate through to the printed substrate, often referred to as the run-in time. During the run in time, the images on the printed substrate are not usable, and are often referred to as "waste." The press may need to be stopped and started a number of times as make-ready adjustments are iteratively made until acceptable print quality is achieved.

One aspect of the make-ready process is ink stabilization. In this regard, during the run-in period noted above, it is generally necessary to operate the press, applying ink and water to the printing plate and transfer the image from the plate to the blanket in order to stabilize the ink transfer process so that the desired ink thickness, typically measured by optical density, is achieved.

During this period, ink will build up on the blanket and must be removed. This traditionally has been accomplished by running a sufficient amount of waste material through the press so as to stabilize the transfer of the ink image by the press. This cycle is repeated each time an adjustment to color or registration is made on the press.

Conventionally, inker make-ready on offset presses has been accomplished by running substrate continuously at the same surface velocity as the inker.

Open loop ink key forcing functions have been applied to improve the natural response of the inker, but substrate is still run through the press during this period resulting in undesirable waste.

U.S. Pat. No. 5,235,913 purports to describe a device and method for stabilizing an offset lithographic printing press. A litho start-off device comprises an ink removal cylinder which can be selectively engaged and disengaged with a blanket disposed on the surface of the blanket cylinder. When engaged with the blanket cylinder, the ink removal cylinder removes ink from the blanket of the blanket cylinder. A scraper assembly is also provided to remove the ink from the ink removal cylinder as it rotates.

BRIEF SUMMARY OF THE INVENTION

In accordance with a first embodiment of the present invention, a method is provided of charging an inker in a lithographic printing press including a plurality of printing units, each printing unit including a blanket cylinder, a plate cylinder, a take away roller, and an ink train. The method comprises placing all of the printing units of the printing press in an off impression position, with a continuous substrate passing through the printing units, each printing unit including a blanket cylinder; and in one or more printing units of the plurality of printing units, moving the takeaway roller into contact with the blanket cylinder of the printing unit. Thereafter, the method includes driving the ink train, plate cylinder, blanket cylinder and the take away roller at a first surface speed, whereby the ink from the ink train transmitted to the plate cylinder from the ink train, from the plate cylinder to the blanket cylinder, and from the blanket cylinder to the take away roller; and during said driving step, keeping the continuous substrate stationary or moving the continuous substrate at a second surface speed less than 50% of the first surface speed.

In accordance with a second embodiment of the present invention, a method is provided of controlling the ink film thickness applied to a printed substrate in a lithographic printing press including a plurality of printing units, each printing unit including a blanket cylinder, a plate cylinder, a take away roller, and an ink train. The method comprises (a) charging the inker in one or more of the plurality of printing units, said charging including the steps of: placing all of the printing units of the printing press in an off impression position, each printing unit including a blanket cylinder; in the one or more printing units of the plurality of printing units, moving the takeaway roller into contact with the blanket cylinder of the printing unit; and thereafter driving the ink train, plate cylinder, blanket cylinder and the take away roller and thereby transmitting ink from the ink train to the plate cylinder, from the plate cylinder to the blanket cylinder, and from the blanket cylinder to the take away roller. The method further comprises, the steps of (b) in the one or more printing units of the plurality of printing units, moving the takeaway roller out of contact with the blanket cylinder of the printing unit; (c) placing the one or more printing units on impression; (d) printing on the substrate with the one or more printing units as the substrate moves through the printing press; (e) measuring an optical density on the moving substrate with an optical sensor; (f) comparing the measured optical density to a predefined metric, and if the measured optical density is within a predefined metric, continuing to print on the substrate, and if the measure optical density is outside the predefined metric, repeating steps (a) through (f).

In accordance with a further aspect of the first embodiment, method may include steps (b) through (f) of the second embodiment.

In accordance with another aspect of the aforementioned embodiments, each printing unit includes an impression cylinder, and the step of placing all of the printing units in the off impression position comprises, in each printing unit, moving an impression cylinder out of contact with the blanket cylinder. Alternatively, each printing unit may include a second blanket cylinder, plate cylinder, take away roller, and ink train, and the step of placing all of the printing units in the off impression position comprises, in each printing unit, separating the blanket cylinder from the second blanket cylinder.

In accordance with another aspect of the aforementioned embodiments, the step of comparing may include comparing the measured optical density to a predefined metric, and if the measured optical density is outside the predefined metric, repeating steps (a) through (f) until the measured optical density is within the predefined metric.

In accordance with another aspect of the aforementioned embodiments, the step of comparing may include comparing the measured optical density to the predefined metric, and then if the measured optical density is outside the predefined metric, repeating steps (a) through (f) until either the measured optical density is within the predefined metric or the measured optical density was outside the predefined metric in a predefined number of consecutive comparisons of step (f), whichever occurs first. In this regard, the predefined metric may include one or more optical density points.

In accordance with a third embodiment of the present invention, an offset lithographic printing press is provided which includes a plurality of printing units arranged to print images on a web, each printing unit including an ink train, a plate cylinder, a blanket cylinder, a take-away roller, and a further cylinder. An optical sensor is positioned downstream of the printing units, and the optical sensor senses an optical density of a printed web as it passes the optical sensor. Each printing unit includes a takeaway roller. The take-away roller is moveable between a first position in contact with the blanket cylinder and a second position spaced away from the blanket cylinder. Each printing unit also includes a throw off mechanism. The throw off mechanism is configured and arranged to bring the blanket cylinder and the further cylinder together to form a nip in an on-impression position, and to separate the blanket cylinder and the further cylinder in an off impression position. The printing press also includes a controller. The controller is connected to each of the printing units and to the optical sensor. The controller is configured and arranged to: (a) control the throw off mechanism in each printing unit to placing all of the printing units of the printing press in the off impression position, (b) move the takeaway roller in one or more of the printing units into the first position; and thereafter (c) drive the ink train, plate cylinder, blanket cylinder, further cylinder and the take away roller and thereby transmit ink from the ink train to the plate cylinder, from the plate cylinder to the blanket cylinder, and from the blanket cylinder to the take away roller; (d) move the takeaway roller in one or more of the printing units into the second position; (e) control the throw off mechanism in the one or more printing units to place the one or more printing units in the on impression position; (f) drive the ink train, plate cylinder, blanket cylinder, and further cylinder and thereby transmit ink from the ink train to the plate cylinder, from the plate cylinder to the blanket cylinder, and from the blanket cylinder to a moving substrate; (g) measure an optical density on the moving substrate from the optical sensor; (h) comparing the measured optical density to a predefined metric, and if the measured optical density is within a predefined metric, continuing to print on the substrate, and if the measure optical density is outside the predefined metric, repeating steps (a) through (h).

BRIEF DESCRIPTION OF THE DRAWINGS

The present invention will be further described with respect to the following Figures, in which.

DETAILED DESCRIPTION OF PREFERRED EMBODIMENTS OF THE INVENTION

Figure 1A:
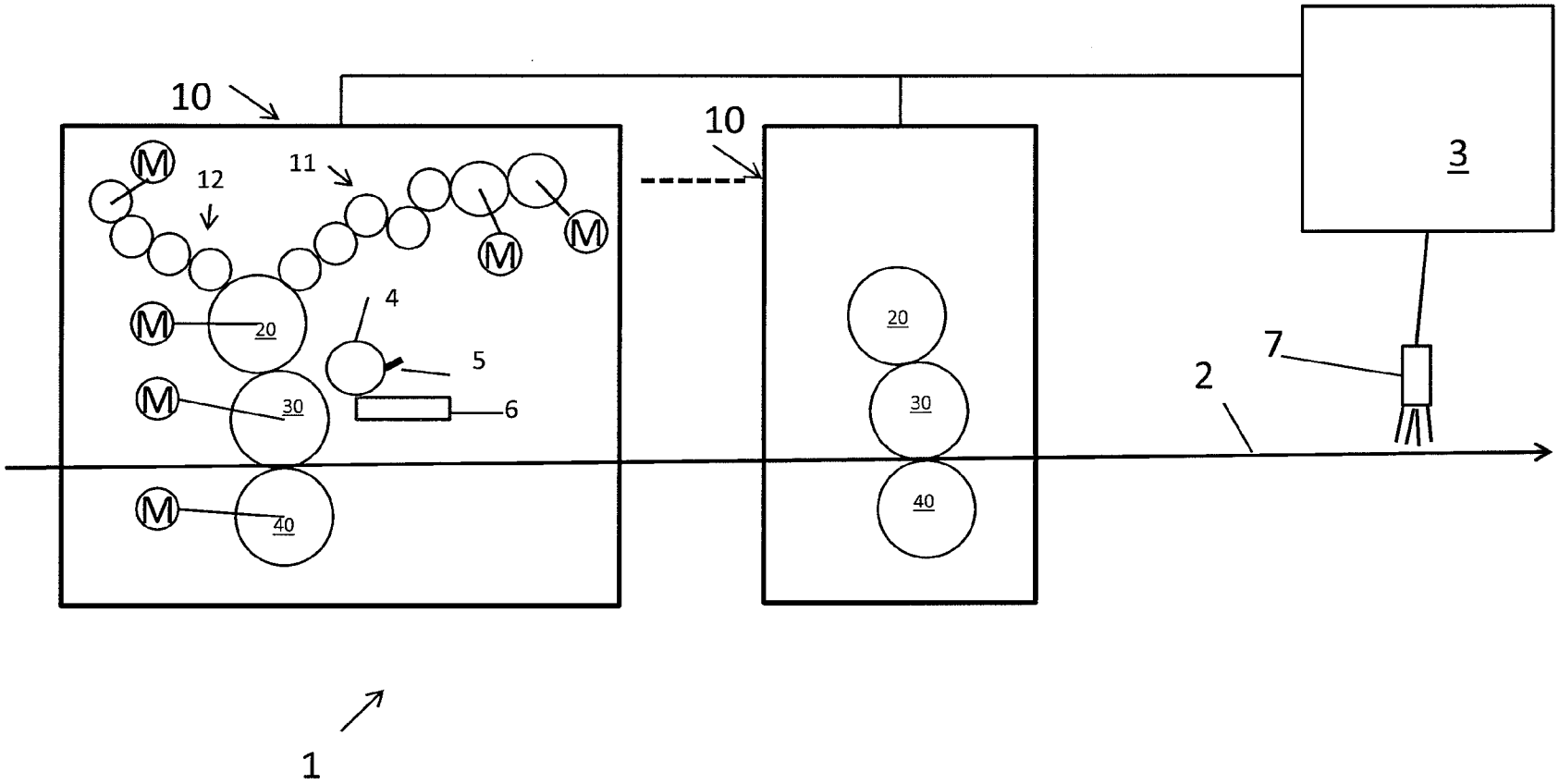
FIG. 1A shows a system in accordance with an embodiment of the present invention in an on-impression position.

As discussed above, in prior art systems, inker make-ready on offset presses was accomplished by running substrate continuously at the same surface velocity as the inker.

These systems are deficient because of the amount of substrate (e.g., web) that is wasted during press start up due to improper ink film thickness on press start up.

In accordance with the embodiments of the present invention discussed below, the amount of substrate wasted during start up to achieve good optical density on the substrate is reduced.

Referring to FIG. 1(A-B), a printing press 1 includes a plurality of printing units 10 for printing on a web 2. A controller 3 is provided for controlling the operation of the printing press 1 as is well known in the art.

Each printing unit 10 includes an ink train 11, a dampener train 12, a plate cylinder 20, and a blanket cylinder 30. Since the press shown in FIG. 1(A-B) is non-perfecting (in other words a printing unit that prints on only one side of the web), an impression cylinder 40 is shown. However, it will be appreciated that the printing units could be perfecting printing units which print on both sides of the web. In such a system, the impression cylinder would be replaced with a second blanket cylinder, and a second plate cylinder, ink train and dampener train would be located below the second blanket cylinder.

In either case, each printing unit can be placed "on impression" or "off impression" as is known in the art. FIG. 1A shows the printing units 10 "on impression." In this regard, the ink and dampener trains 11, 12 are engaged with the plate cylinder 20, the plate cylinder 20 forms a nip with the blanket cylinder 30, and the blanket cylinder 30 forms a nip with the impression cylinder 40. In this position, the printing unit can print images onto the web 2. In this regard, it should be noted that there is a removable printing plate on the plate cylinder and a removable printing blanket on the blanket cylinder. However, as used herein, the term plate cylinder should be understood to refer to the plate cylinder inclusive of the printing plate, and the term blanket cylinder should be understood to refer to the blanket cylinder inclusive of the blanket, unless the context makes clear that the plate or blanket has been removed.

Figure 1B:
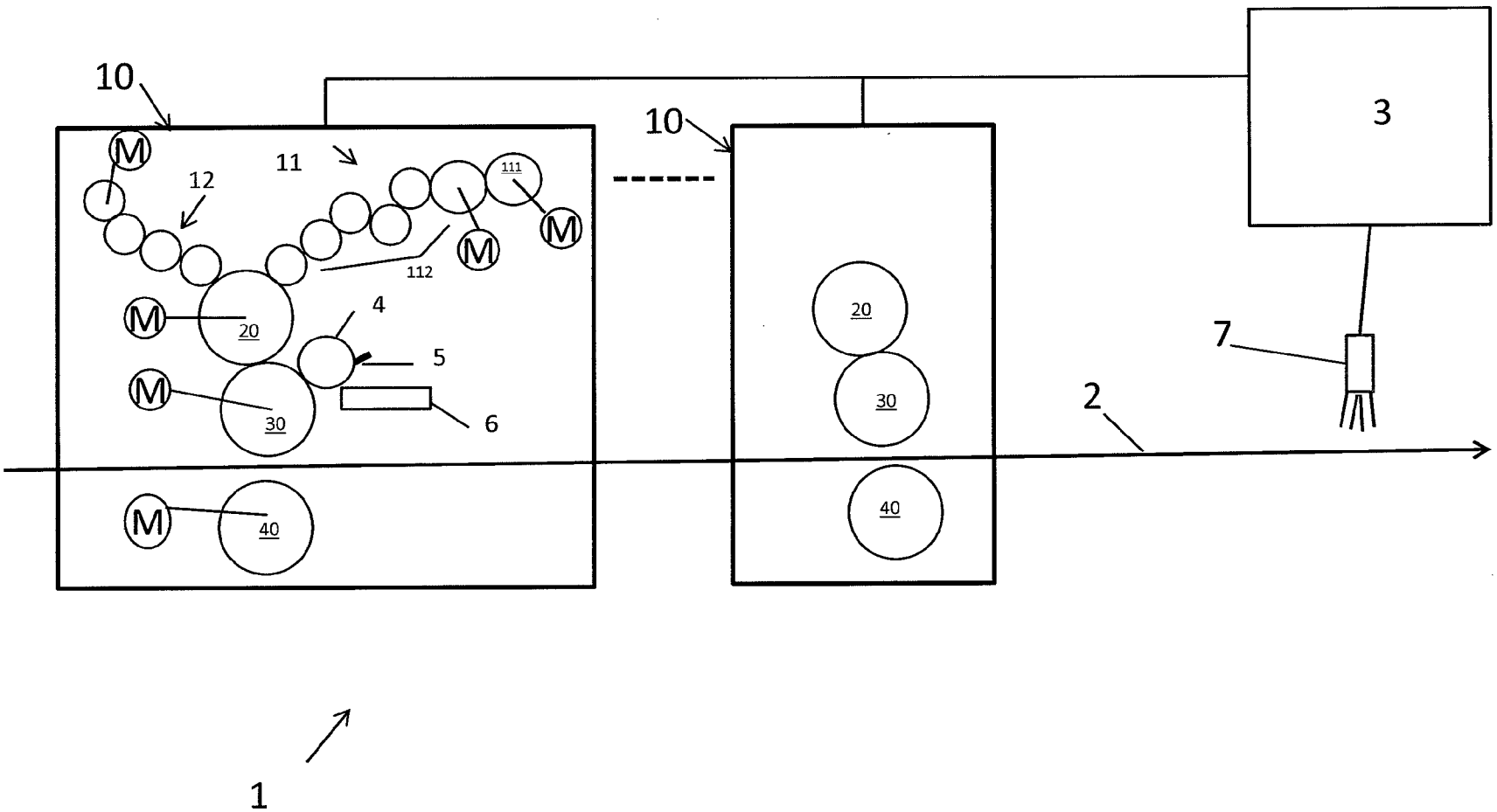
FIG. 1B shows the system of FIG. 1A in an off-impression position.

FIG. 1B shows the printing units 10 is in an off-impression position. In this position, the blanket cylinder 30 is spaced apart from the web 2. This can be accomplished in a number of ways which are known in the art.

In a non-perfecting press, moving the impression cylinder 30 out of contact with the blanket cylinder 20 will typically cause the blanket cylinder 30 to come out of contact with the web.

Alternatively, the blanket cylinder 30 could be moved upward out of contact with the impression cylinder 40 while the impression cylinder 40 either remains in a fixed position or moves downward. This may or may not require movement of the plate cylinder 20, ink train 11, and/or dampening train 12. For example, depending on the arrangement, blanket cylinder 30 could move in an arcuate upward path while the plate cylinder remains in place.

In a perfecting printing unit, the upper blanket cylinder would move upward and/or the lower blanket cylinder would move downward. Depending on the arrangement of the plate cylinder, ink train and dampener train, these components may also move when the printing unit is taken off impression.

There are a wide variety of well known mechanisms that can be used to move the various cylinders and components on and off impression. Non-limiting examples include mounting the cylinders 20, 30, and/or 40 in eccentric bearings, mounting the cylinders 20, 30, and/or 40 on pivotable brackets, mounting the cylinders 20, 30, and/or 40 on tracks or carriages, and combinations of the foregoing. These mechanisms can be actuated by the controller 3 with a wide variety of actuators, including motors, hydraulic cylinders, pneumatic cylinders, and the like.

Referring again to FIGS. 1A and 1B, each printing unit 10 according to the present invention also includes a takeaway roller 4 which can be brought into and out of contact with the blanket cylinder 30. When the printing unit is off impression and the inker 11, dampener 12, plate and blanket cylinders 20, 30 are rotating to apply ink to the blanket cylinder 30, the takeaway roller 4 is brought into contact with the blanket cylinder to remove ink from the blanket cylinder. Scraper blade 5 scrapes the ink off the takeaway roller 4 so that the ink is deposited into tray 6. During a printing operation, when the printing unit is on impression and printing on the web, the takeaway roller 4 is brought out of contact with the blanket cylinder 30. Preferably, take away roller 4 is made of a material which has a similar affinity to ink and water as the substrate on which the press is designed to print (e.g. paper). A non-limiting example is a roll with a CERAL-AST™ material available from a division of the American Roller, Co.

As illustrated in FIGS. 1A and 1B, in each printing unit 10, the inker 11, dampener 12, plate cylinder 20, blanket cylinder 30, and impression cylinder 40 are each driven by an independent motor (M). In addition, within the inker 11, the ink roll 111 may be driven independently of the ink train 112.

Takeaway roller 4 can be driven through its contact with the blanket cylinder 30 and thus does not require its own motor. However, if desired, roller 4 could be driven, either by a separate motor or via a connection to another motor, for example, the blanket cylinder motor. A wide variety of mechanism can be used to move the takeaway roller into and out of engagement with the blanket cylinder, including mounting the roller 4 in eccentric bearings, mounting the roller 4 on pivotable brackets, mounting the roller 4 on tracks or carriages, and combinations of the foregoing. These mechanisms can be actuated under by controller 3 with a wide variety of actuators, including motors, hydraulic cylinders, pneumatic cylinders, and the like.

Further, it is possible to drive the inker 11, dampener 12, plate cylinder 20, and blanket cylinder 30 with a common motor, while the impression cylinder 40 is driven with a separate motor. As is well known in the art, in a non-perfecting press the speed of the web is controlled by the impression cylinder due to one or more factors including the wrap angle around the impression cylinder, the metal surface of the impression cylinder as compared to the more slippery surface of a blanket carrying ink, and/or the diameter of the impression cylinder.

Finally, in perfecting or non-perfecting units in which the upper and lower blanket cylinders or blanket cylinder and impression cylinder are spaced apart from the web in the off-impression position, it is also possible to drive the entire printing unit (or the entire press) with a single motor.

Ink take away roller 4 is applied at the blanket cylinder 30 during the period of inker fluid stabilization to remove ink and water from the blanket in a manner similar to how the web 2 removes ink and water from the blanket. The ink placed on the blanket is discharged to the take away roller 4 rather than to the web substrate 2. Ink and water which is being removed in this manner would normally be removed via the web substrate and would be considered waste.

Substrate waste is a costly start-up component. Reducing start-up substrate waste is highly desirable. In accordance with a first aspect of the present invention, the inker 11 is run at higher surface speeds than the web during make-ready and the cycling process of inker charging and ink film thickness correction. During this time, the web can be stopped entirely, or moved slowly at less than half the surface speed of the inker, thereby reducing substrate waste on start-up.

Inker motion can be made completely independently of impression (web substrate) motion through the use of independent motors. Having independently driven axes for ink train, ink roll, impression cylinder, plate, and blanket makes it possible to stop running substrate and to run the ink train and ink roll independently at any speed desired. Running the ink train in this manner, at a higher speed, permits charging the ink train in less time. Production time, crew time, and machine time is therefore preserved. Preferably, the ink train, dampener train, plate cylinder, and blanket cylinder are driven at the same surface speed in order to maintain the desired ink split, which is typically 2 to 1, i.e. each successive roller transmits ½ its ink to the next roller.

A second aspect of the present invention involves making optical density measurements with an optical sensor 7 after a charge cycle of the inker to the take away roll. When a charge cycle to the take away roll is complete, the substrate is run and an optical density measurement is taken to determine the new ink film thickness achieved on the substrate. Controller 3 measures the optical density with optical sensor 7 and determines if corrections to the inker setting are required to achieve a desired ink thickness. If corrections are required, the controller applies the new inker settings and the inker runs through another charging cycle with the substrate stopped, or running at a slow speed which is less than 50% of the surface speed of the inker. The goal of each charging cycle is to establish an ink film thickness on the substrate which can be produced and shipped with defined quality metrics.

In this regard, the metric for optical density is typically defined in optical density points (e.g. 1.2 optical density points, 1.4 optical density points) and a given print job will have a target optical density. For example, a particular color desired by an advertiser may desire 1.3 optical density points. The optical sensor 7 will detect the optical density, either on the image itself or in a color bar, and that optical density will be compared with the desired optical density points. If the detected optical density is 10% below the desired target optical density, for example, then the ink metering device will be opened (e.g., 10%), the inker will run through another charging cycle with the substrate stopped, and then the press will print on the web and the optical density detected again. This process can be repeated until the optical density meets the target, or until a defined number of iterations have occurred, whichever comes first.

An exemplary flow chart for closed loop control of ink film thickness is as follows:

(a) optical density measurements are made on the moving web (b) once optical density of a target or targets on the web is acquired, the targets are evaluated against desired metrics;

(c) If the optical density measured is within the production metric set defined for the print job, the web continues to run and the press goes into normal production.

(d) If the optical density measurement is out of the production metric defined, the substrate is halted.

(1) Ink key positions are then modified by the closed loop control algorithm to establish a new ink film thickness.

(2) The take away roll goes through another charge cycle and the process described is repeated.

This cycle is repeated until the optical density measured on the web is within the defined metric set or terminated after x number of predetermined correction cycles.

It should be noted that the manner in which a controller, such as controller 3 can be configured to control the supply of ink to different ink zones is well known in the art and therefore will not be recounted herein. Rather, the embodiments of the present invention are directed to a novel control system. In this regard, controller 3 can, for example, be one or more programmable logic controller(s) (PLC), or any suitable hardware based or software based electronic controller or controllers including, for example, one or more microcomputers with related support circuitry, one or more finite static machine(s), one or more field programmable gate array(s), FPGA, or one or more application-specific integrated circuit(s), ASIC, among others.

Figure 2:
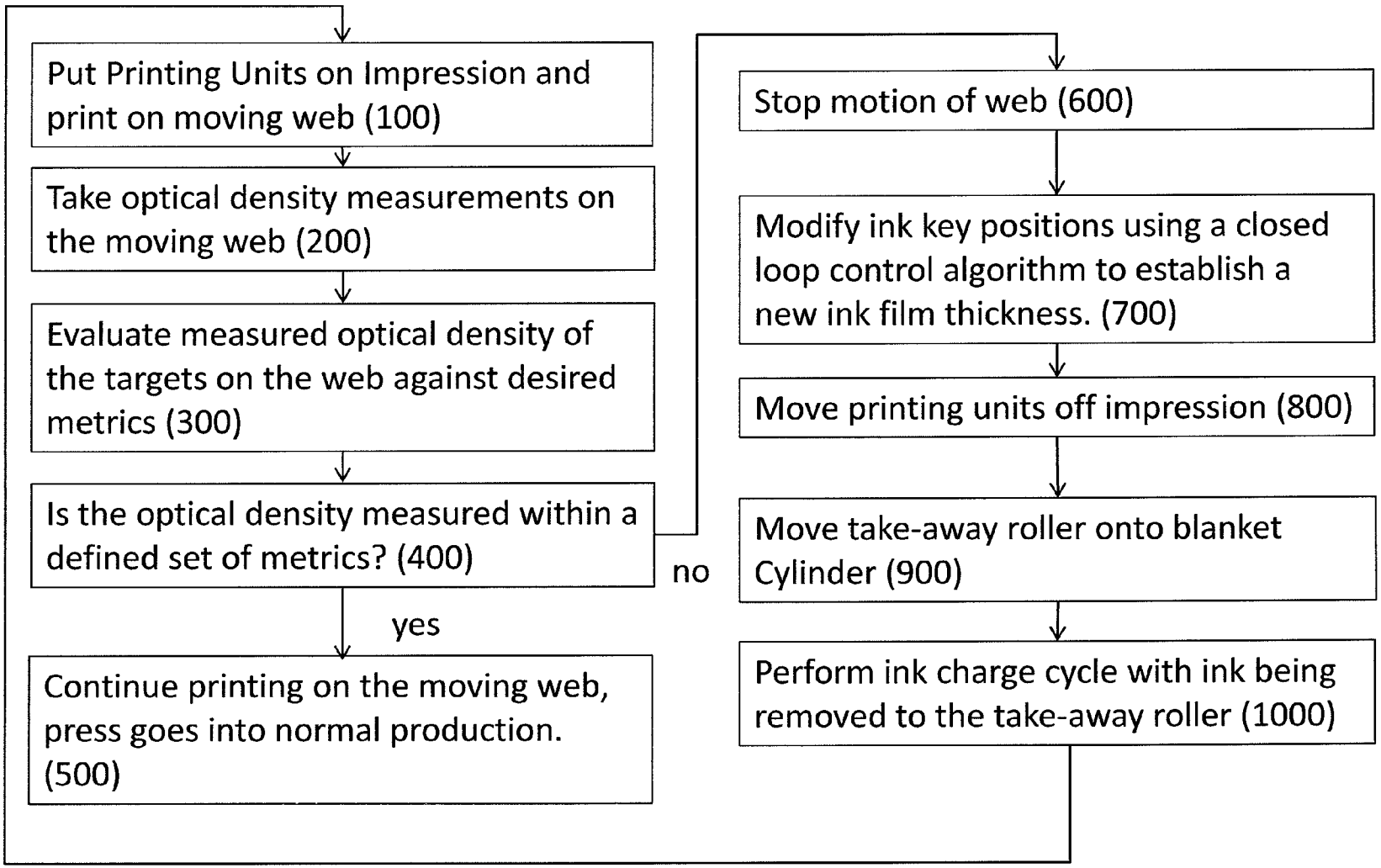
FIG. 2 is an illustrative flow chart for a controller for providing closed loop control of ink film thickness.

FIG. 2 is an illustrative flow chart which shows the steps that may be performed by the controller 3, using dedicated hardware circuitry (such as ASICS, FPGAs), software, or a combination of dedicated hardware circuitry and software. Referring to FIG. 2, in step 100 the controller provides instructions to place the printing units on impression and begin printing as is well known in the art. In step 200, the controller receives and processes data from the optical sensor 7 to determine the optical density on the web. In step 300, the controller compares the measured optical density to desired metrics. As noted earlier, optical density is typically evaluated in terms of optical density points. Accordingly, a given print job may have a desired optical density of 1.2 points+/−0.1 points. The optical sensor or sensors are positioned to detect either the color bar printed on the edge of the web or to detect the image itself. The controller 300 determines the optical density of the target (i.e., what is detected on the web), and compares it to the desired metric, for example, 1.2+/−0.1 points. If the optical density measured is within the desired metric (i.e. 1.2+/−0 0.1) at step 400, then the web continues to run and the press goes into normal production (step 500). If the optical density measured is not within the desired metric at step 400, the controller 3 instructs the press to halt the substrate (step 600), the controller controls the inker to modify the ink key positions to establish a new ink film thickness (step 700), and the controller moves the printing units off impression (step 800) and moves the takeaway roller onto the blanket cylinder (step 900). It should be noted that the steps 700, 800, and 900 need not necessarily be in sequence. As noted in step 700, the ink key positions are modified "by a closed loop control algorithm." This algorithm can be simple or complex. As noted above, the algorithm can simply open/close the ink metering device by X % if the density is outside the desired metric by X percent. Alternatively, look up tables can be created based on empirical data, statistical techniques can be applied to the data, or other mathematical techniques can be employed as desired.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A method of charging an inker in a lithographic printing press including a plurality of printing units, each printing unit including a blanket cylinder, a plate cylinder, a take away roller, and an ink train, comprising:

placing all of the printing units of the printing press in an off impression position, with a continuous substrate extending through the printing units;

thereafter, in one or more printing units of the plurality of printing units, moving the takeaway roller into contact with the blanket cylinder of the printing unit;

thereafter, driving the ink train, plate cylinder, blanket cylinder and the take away roller at a first surface speed, whereby ink from the ink train transmitted to the plate cylinder from the ink train, from the plate cylinder to the blanket cylinder, and from the blanket cylinder to the take away roller is removed; and during said driving step, keeping the continuous substrate stationary.

2. The method of claim 1, wherein each printing unit includes an impression cylinder, and the step of placing all of the printing units in the off impression position comprises, in each printing unit:

moving the impression cylinder out of contact with the blanket cylinder.

3. The method of claim 1, wherein each printing unit includes a second blanket cylinder, plate cylinder, take away roller, and ink train, and wherein the step of placing all of the printing units in the off impression position comprises, in each printing unit:

separating the blanket cylinder from the second blanket cylinder.

4. A method of controlling an ink film thickness applied to a printed substrate in a lithographic printing press including a plurality of printing units, each printing unit including a blanket cylinder, a plate cylinder, a take away roller, and an ink train, comprising:

(a) charging an inker in the one or more printing units in accordance with the method of claim 1;

(b) in the one or more printing units of the plurality of printing units, moving the takeaway roller out of contact with the blanket cylinder of the printing unit (c) placing the one or more printing units on impression;

(d) printing on the substrate with the one or more printing units as the substrate moves through the printing press;

(e) measuring an optical density on the moving substrate with an optical sensor;

(f) comparing the measured optical density to a predefined metric, and if the measured optical density is within a predefined metric, continuing to print on the substrate, and if the measure optical density is outside the predefined metric, repeating steps (a) through (f).

5. The method of claim 4, wherein the step of comparing includes comparing the measured optical density to a predefined metric, and if the measured optical density is outside the predefined metric, repeating steps (a) through (f) until the measured optical density is within the predefined metric.

6. The method of claim 4, wherein the step of comparing includes comparing the measured optical density to the predefined metric, and the if the measured optical density is outside the predefined metric, repeating steps (a) through (f) until either the measured optical density is within the predefined metric or the measured optical density was outside the predefined metric in a predefined number of consecutive comparisons of step (f), whichever occurs first.

7. The method of claim 4, wherein the predefined metric includes one or more optical density points.

8. A method of controlling an ink film thickness applied to a continuous substrate to be printed in a lithographic printing press including a plurality of printing units, each printing unit including a blanket cylinder, a plate cylinder, a take away roller, and an ink train, comprising:

(a) charging an inker in one or more of the plurality of printing units with the continuous substrate extending through the printing units, said charging including the steps of:

placing all of the printing units of the printing press in an off impression position;

thereafter, in the one or more printing units of the plurality of printing units, moving the takeaway roller into contact with the blanket cylinder of the printing unit;

thereafter, driving the ink train, plate cylinder, blanket cylinder and the take away roller, whereby ink from the ink train transmitted to the plate cylinder from the ink train, from the plate cylinder to the blanket cylinder, and from the blanket cylinder to the take away roller is removed;

(b) in the one or more printing units of the plurality of printing units, with the continuous substrate extending through the printing units, moving the takeaway roller out of contact with the blanket cylinder of the printing unit;

(c) placing the one or more printing units on impression;

(d) printing on the substrate with the one or more printing units as the substrate moves through the printing press;

(e) measuring an optical density on the moving substrate with an optical sensor;

(f) comparing the measured optical density to a predefined metric, and if the measured optical density is within a predefined metric, continuing to print on the substrate, and if the measure optical density is outside the predefined metric, repeating steps (a) through (f).

9. The method of claim 8, wherein each printing unit includes and impression cylinder, and the step of placing all of the printing units in the off impression position comprises, in each printing unit:

moving an impression cylinder out of contact with the blanket cylinder.

10. The method of claim 8, wherein each printing unit includes a second blanket cylinder, plate cylinder, take away roller, and ink train, and wherein the step of placing all of the printing units in the off impression position comprises, in each printing unit:

separating the blanket cylinder from the second blanket cylinder.

11. The method of claim 8, wherein the step of comparing includes comparing the measured optical density to a predefined metric, and if the measured optical density is outside the predefined metric, repeating steps (a) through (f) until the measured optical density is within the predefined metric.

12. The method of claim 8, wherein the step of comparing includes comparing the measured optical density to the predefined metric, and the if the measured optical density is outside the predefined metric, repeating steps (a) through (f) until either the measured optical density is within the predefined metric or the measured optical density was outside the predefined metric in a predefined number of consecutive comparisons of step (f), whichever occurs first.

13. The method of claim 8, wherein the predefined metric includes one or more optical density points.

14. The method of claim 8, wherein, during said driving step, the method further includes keeping the continuous substrate extending through the printing units stationary.

15. The method of claim 8, wherein, during said driving step, the ink train, plate cylinder, blanket cylinder and the take away roller rotate at a first surface speed, and the web moves at a second surface speed that is less than 50% of the first surface speed.

16. An offset lithographic printing press, comprising:

a plurality of printing units arranged to print images on a web, each printing unit including an ink train, a plate cylinder, a blanket cylinder, a take-away roller, and a further cylinder, the web passing through the printing units, an optical sensor positioned downstream of the printing units, the optical sensor sensing an optical density of a printed web as the printed web passes the optical sensor;

each printing unit including a takeaway roller, the take-away roller being moveable between a first position in contact with the blanket cylinder and a second position spaced away from the blanket cylinder;

each printing unit including a throw off mechanism, the throw off mechanism being configured and arranged to bring the blanket cylinder and the further cylinder together to form a nip in an on-impression position, and to separate the blanket cylinder and the further cylinder in an off impression position;

a controller, the controller connected to each of the printing units and to the optical sensor, the controller configured and arranged to:

(a) control the throw off mechanism in each printing unit to placing all of the printing units of the printing press in the off impression position with the web extending through the printing units, and thereafter, (b) move the takeaway roller in one or more of the printing units into the first position with the web extending through the printing units; and thereafter (c) drive the ink train, plate cylinder, blanket cylinder, further cylinder and the take away roller and thereby transmit ink from the ink train to the plate cylinder, from the plate cylinder to the blanket cylinder, and from the blanket cylinder to the take away roller at a first surface speed while keeping the web stationary;

(d) move the takeaway roller in one or more of the printing units into the second position;

(e) control the throw off mechanism in the one or more printing units to place the one or more printing units in the on impression position;

(f) drive the ink train, plate cylinder, blanket cylinder, and further cylinder and thereby transmit ink from the ink train to the plate cylinder, from the plate cylinder to the blanket cylinder, and from the blanket cylinder as the web moves through the printing units;

(g) measure an optical density on the moving substrate from the optical sensor;

(h) comparing the measured optical density to a predefined metric, and if the measured optical density is within a predefined metric, continuing to print on the web, and if the measure optical density is outside the predefined metric, repeating steps (a) through (h).

* * * * *